US009808928B2

(12) United States Patent
Bothmann et al.

(10) Patent No.: US 9,808,928 B2
(45) Date of Patent: Nov. 7, 2017

(54) REINFORCEMENT MEMBER FOR HANDLE OF TOOL

(71) Applicant: Snap-on Incorporated, Kenosha, WI (US)

(72) Inventors: Richard D. Bothmann, Grayslake, IL (US); Paul W Griffin, Kenosha, WI (US); Dennis A Nowak, Franklin, WI (US); Benjamin E Kohls, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 415 days.

(21) Appl. No.: 14/716,299

(22) Filed: May 19, 2015

(65) Prior Publication Data

US 2016/0339578 A1 Nov. 24, 2016

(51) Int. Cl.
*B25F 5/02* (2006.01)

(52) U.S. Cl.
CPC ..... *B25F 5/02* (2013.01)

(58) Field of Classification Search
CPC ..... B25F 5/02; E21B 1/00
USPC ..... 173/170; 310/47, 50
See application file for complete search history.

(56) References Cited

U.S. PATENT DOCUMENTS

| | | | | |
|---|---|---|---|---|
| 6,446,734 | B1 * | 9/2002 | Williams | B25F 5/02 173/1 |
| 8,205,684 | B2 * | 6/2012 | Kokinelis | B25F 5/008 173/162.2 |
| 8,430,183 | B2 | 4/2013 | Di Nicolantonio et al. | |
| 2008/0000665 | A1 | 1/2008 | Kokinelis et al. | |
| 2009/0194306 | A1 | 8/2009 | Johnson et al. | |

FOREIGN PATENT DOCUMENTS

| | | | |
|---|---|---|---|
| CA | 2590879 | A1 | 11/2007 |
| EP | 1862268 | A2 | 5/2007 |

OTHER PUBLICATIONS

Canadian Examiner Report, dated Dec. 6, 2016; 4 pages.
Australian Patent Office Patent Examination Report No. 1, dated Oct. 21, 2016; 5 pages.
United Kingdom Intellectual Property Office Combined Search and Examination Report, dated Jun. 28, 2016; 6 pages.

* cited by examiner

*Primary Examiner* — Nathaniel Chukwurah
(74) *Attorney, Agent, or Firm* — Seyfarth Shaw LLP

(57) ABSTRACT

A tool, such as a pneumatic tool, having a first and second housing portions coupled together. The first housing portion including an upper portion adapted to receive power and transmission components and a handle portion including a recess adapted to receive a trigger assembly. A reinforcement member is disposed in the recess with a first side facing in a first direction away from the recess and towards the second housing portion, and a protrusion extending from the first side in the first direction. The protrusion engages the second housing portion and strengthens the handle portion to allow the handle portion to withstand forces resulting from the tool being dropped on a hard surface.

20 Claims, 6 Drawing Sheets

REINFORCEMENT MEMBER FOR HANDLE OF TOOL

TECHNICAL FIELD

The present invention relates broadly to reinforcement of handle portions of tools. More particularly, the present invention relates generally to a reinforcement member of a handle of a pneumatic or hydraulic power tool.

BACKGROUND

Many tools are powered by pneumatic air or hydraulic fluid that provides the necessary pneumatic or hydraulic power to the tool. Impact wrenches, for example, can use pressurized air to impart torque to a work piece to loosen or tighten the work piece. Such tools tend to undergo a large amount of abuse, such as accidentally being dropped on a hard surface. Some of these tools may include a handle and/or outer housing made of a plastic material. This plastic material may not be as strong and durable as other materials, and may tend to break or fracture when abused or dropped.

SUMMARY

The present invention broadly includes a reinforcement member that bridges across an upper portion of the tool and a handle. This strengthens a transition area of the tool between the upper portion and the handle and provides an alternate load path to enable the handle to withstand forces that result from being dropped on a hard surface, such as concrete.

An embodiment of the present invention broadly includes a tool having a first and second housing portions coupled together. The first housing portion including an upper portion adapted to receive power and transmission components and a handle portion including a recess adapted to receive a trigger assembly. A reinforcement member is disposed in the recess with a first side facing in a first direction away from the recess and towards the second housing portion, and a protrusion extending from the first side in the first direction. The protrusion engages the second housing portion and strengthens the handle portion to allow the handle portion to withstand forces resulting from the tool being dropped on a hard surface.

In another embodiment, a reinforcement member broadly includes a first side and a second opposing side, a protrusion extending from the first side in the first direction, and an aperture extending from the first side to the second side. The first side is adapted to be disposed in a first direction away from a recess in a handle portion of the tool, wherein the handle portion is adapted to receive a trigger assembly. The protrusion is adapted to engage a housing portion of the tool and strengthen the handle portion, and the aperture is adapted to align with a trigger receiving aperture in the recess of the handle portion.

In another embodiment, a method of installing a reinforcement member of a tool broadly includes disposing a reinforcement member in a recess in a handle portion of a first housing portion of the tool. The reinforcement member includes a first side disposed in a first direction away from the recess and a protrusion extending from the first side in the first direction. The method further includes disposing a second housing portion of the tool on the first housing portion and in engagement with the protrusion.

BRIEF DESCRIPTION OF THE DRAWINGS

For the purpose of facilitating an understanding of the invention, there are illustrated in the accompanying drawings embodiments thereof, from an inspection of which, when considered in connection with the following description, the invention, its construction and operation, and many of its advantages should be readily understood and appreciated.

DETAILED DESCRIPTION

Figure 1:
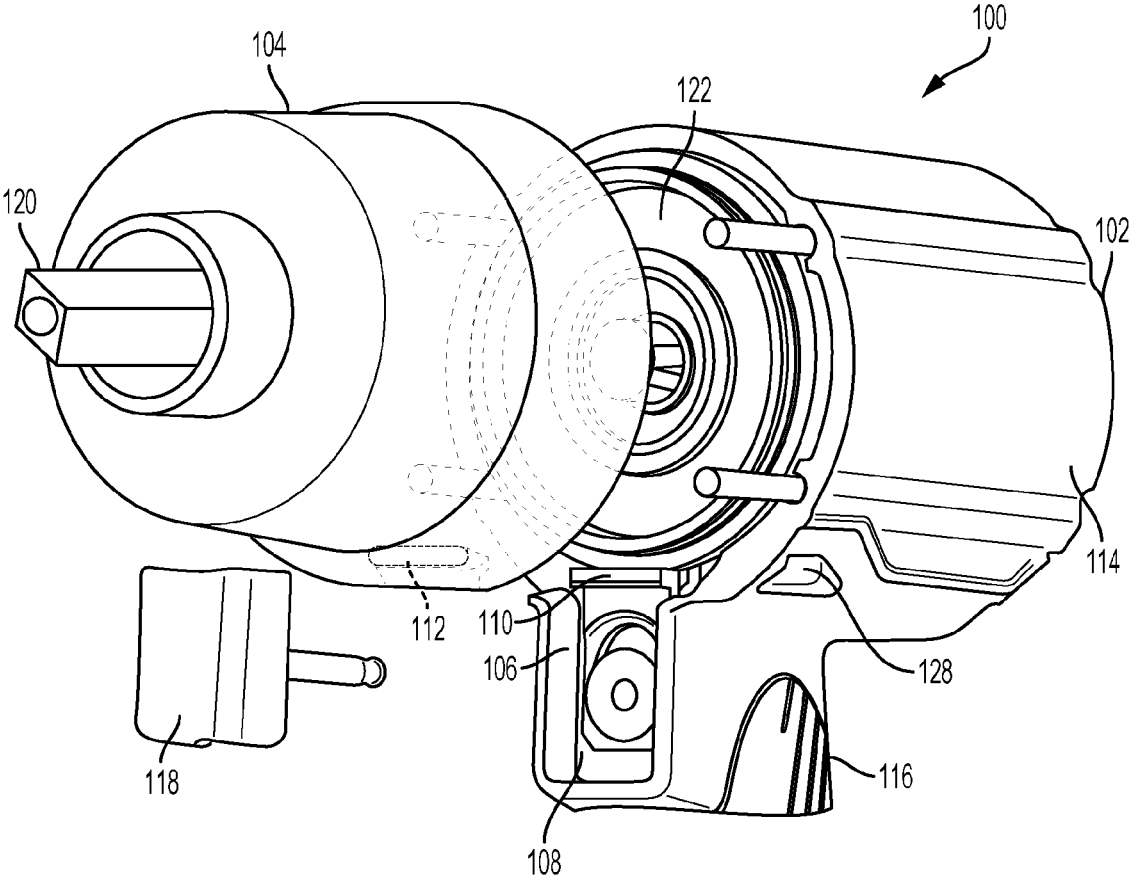
FIG. 1 is an exploded perspective view of a tool with a front housing and trigger removed according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly includes a reinforcement member that bridges across an upper portion of the tool and a handle. This strengthens a transition area of the tool between the upper portion and the handle and provides an alternate load path to enable the handle to withstand forces that result from being dropped on a hard surface, such as concrete.

Figure 2:
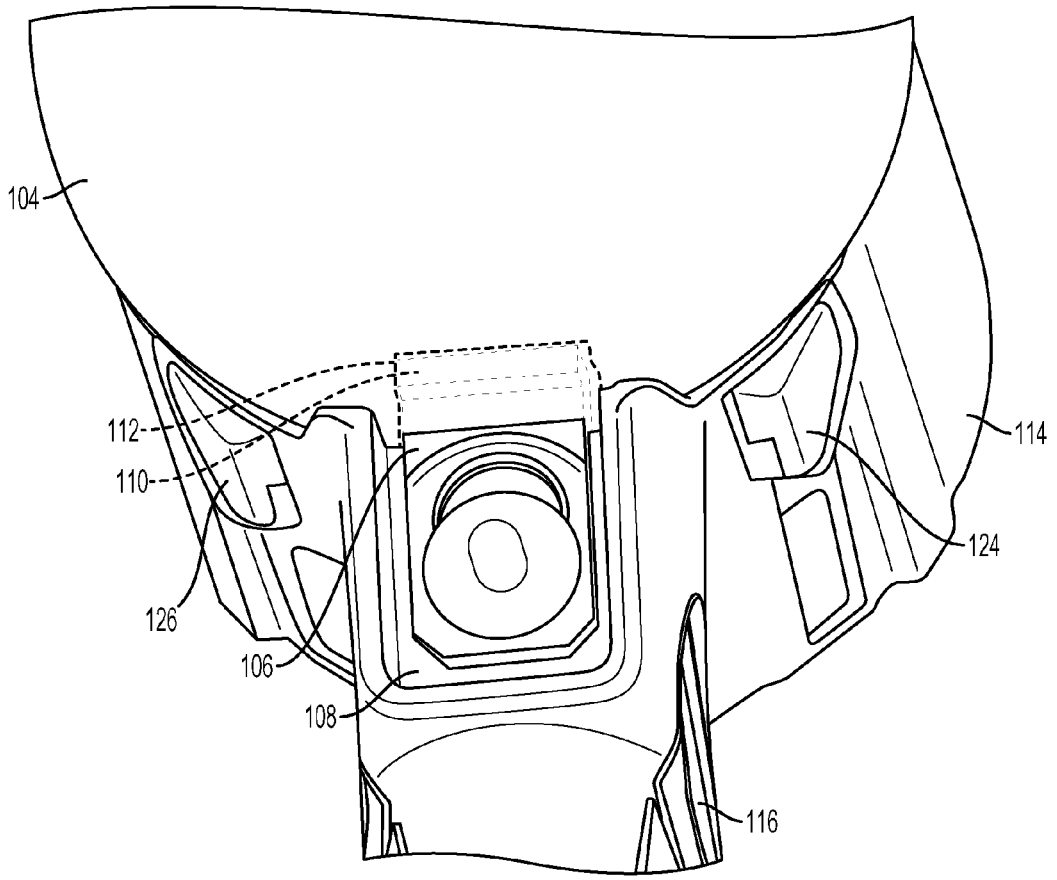
FIG. 2 is an enlarged sectional view of a trigger area of a tool with a trigger removed according to an embodiment of the present invention.

Referring to FIGS. 1 and 2, a tool 100, such as a pneumatic impact wrench, includes a first housing 102 and second housing 104, a reinforcement member 106 disposed in a recess 108 of the first housing 102. The reinforcement member 106 includes a male protrusion 110 that mates with a corresponding female recess 112 in the second housing 104. The reinforcement member 106 provides an alternate load path and strengthens a transition area of the tool 100 between an upper portion 114 and handle portion 116. This allows the handle portion 116 to withstand forces that result from being dropped on a hard surface. In another embodiment, the reinforcement member 106 may include a recess that mates with a corresponding protrusion of the second cover portion 104.

The tool 100 may also include a trigger 118 that may be disposed in the recess 108, and configured to operate a drive lug 120 operably coupled to power and transmission components 122 disposed in the first housing 102. The drive lug 120, can be coupled to other devices, such as a socket, to apply torque to a work piece, as known in the art. The power and transmission components 122 may include a cylinder having a rotor that rotates so as to impart torque upon the drive lug 120 and, by extension, on a work piece.

In general, the trigger 118 can be actuated by a user to cause pressurized air from an external supply to operate the tool 100, such as the power and transmission components 122 of the tool 100. The trigger 118 can be biased such that the user can depress the trigger 118 inwardly, relative to the tool 100, to cause the tool 100 to operate by pneumatic or fluid power, and release the trigger 118, wherein the biased nature of the trigger 118 causes the trigger 118 to move outwardly, relative to the tool 100, to end the tool's operation.

The tool 100 may also include a reversing mechanism having a first button 124 corresponding to a first direction of rotation, and a second button 126 corresponding to a second direction of rotation. The first and second buttons 124, 126 respectively are disposed in receiving apertures 128 on opposing sides of the tool 100. To change the rotational direction of the drive lug 120, a user may depress either of first or second buttons 124, 126 respectively. For example, depressing the first button 124 may cause the drive lug 120 to rotate in a first or clockwise rotational direction, and depressing the second button 126 may cause the drive lug 120 to rotate in a second or counterclockwise rotational direction. As illustrated, the first and second buttons 124, 126 are disposed near the recess 108 and trigger 118, within easy reach of a user's fingers during operation of the tool 100 to allow the user to change the rotational direction without disengaging the tool 100 from a work piece.

In an embodiment, the first and second housings 102, 104 respectively may be constructed out of a plastic material, or one of the housings (such as first housing 102) may be constructed out of a plastic material, and the other housing (such as second housing 104) may be constructed out or a metal material. In these embodiments, the first housing 102 may be susceptible to failure between the upper portion 114 and handle portion 116 due to forces that result from the tool 100 being dropped on a hard surface. This susceptibility to failure may be caused by the location of the reversing mechanism and receiving apertures 128. This location is commonly used in cordless and corded tools to provide a user with an easy to access reversing mechanism. However, cracks can grow out of the receiving apertures 128 resulting from the tool 100 being dropped. In other tools, that do not include the reversing mechanism and receiving apertures 128, may also tend to fail at the transition from the upper portion 114 to the handle portion 116.

The reinforcement member 106 addresses these issues, by providing an alternate load path and strengthening the transition area of the tool 100 between the upper portion 114 and handle portion 116. For example, the reinforcement member 106 adds a load carrying member to the first and second housings 102 and 104. In the embodiment where the first housing 102 is plastic and the second housing 104 is metal, the reinforcement member 106 connects to the first housing 102 through a trigger bushing 138 (described in further detail with reference to FIG. 4), and the second housing 104 via the recess 112. The trigger bushing 138 spreads the load over a large area to prevent deformation, and the metal second housing 104 is capable of handling a concentrated load without deformation.

Figure 3A:
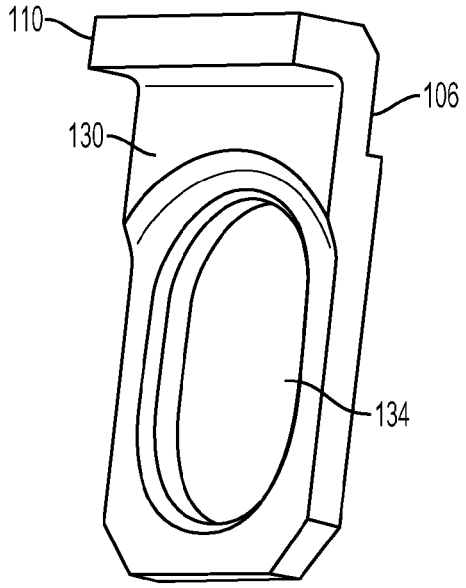
FIGS. 3A and 3B are a front and rear perspective views of a reinforcement member according to an embodiment of the present invention.
Figure 3B:
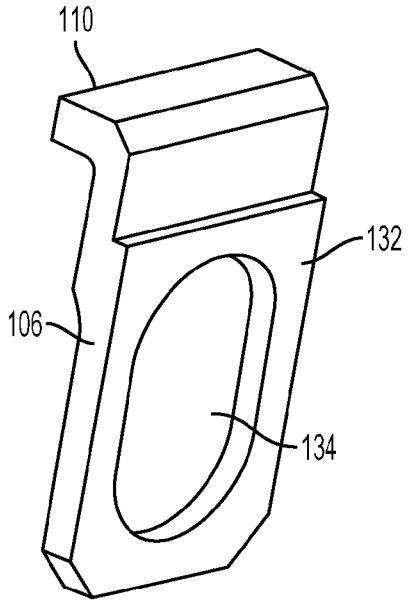

Referring to FIGS. 3A and 3B, the reinforcement member 106 includes a first side 130 and a second side 132, the male protrusion 110 extending from the first side 130, and an aperture 134. The reinforcement member 106 may be sized and shaped to fit within the recess 108 (illustrated in FIGS. 1 and 2) with the first side 130 and male protrusion 110 oriented in a direction of the second housing 104 (illustrated in FIGS. 1 and 2), and the second side 132 oriented in a direction of the first housing 102 (illustrated in FIGS. 1 and 2). The aperture 134 may be configured to accommodate one or more components of a trigger mechanism of the tool 100, as described in further detail below. This allows the reinforcement member 106 to be retrofitted onto existing tools to provide an alternate load path and strengthen the transition area, such as between the upper portion 114 and handle portion 116 illustrated in FIGS. 1 and 2.

Figure 4:
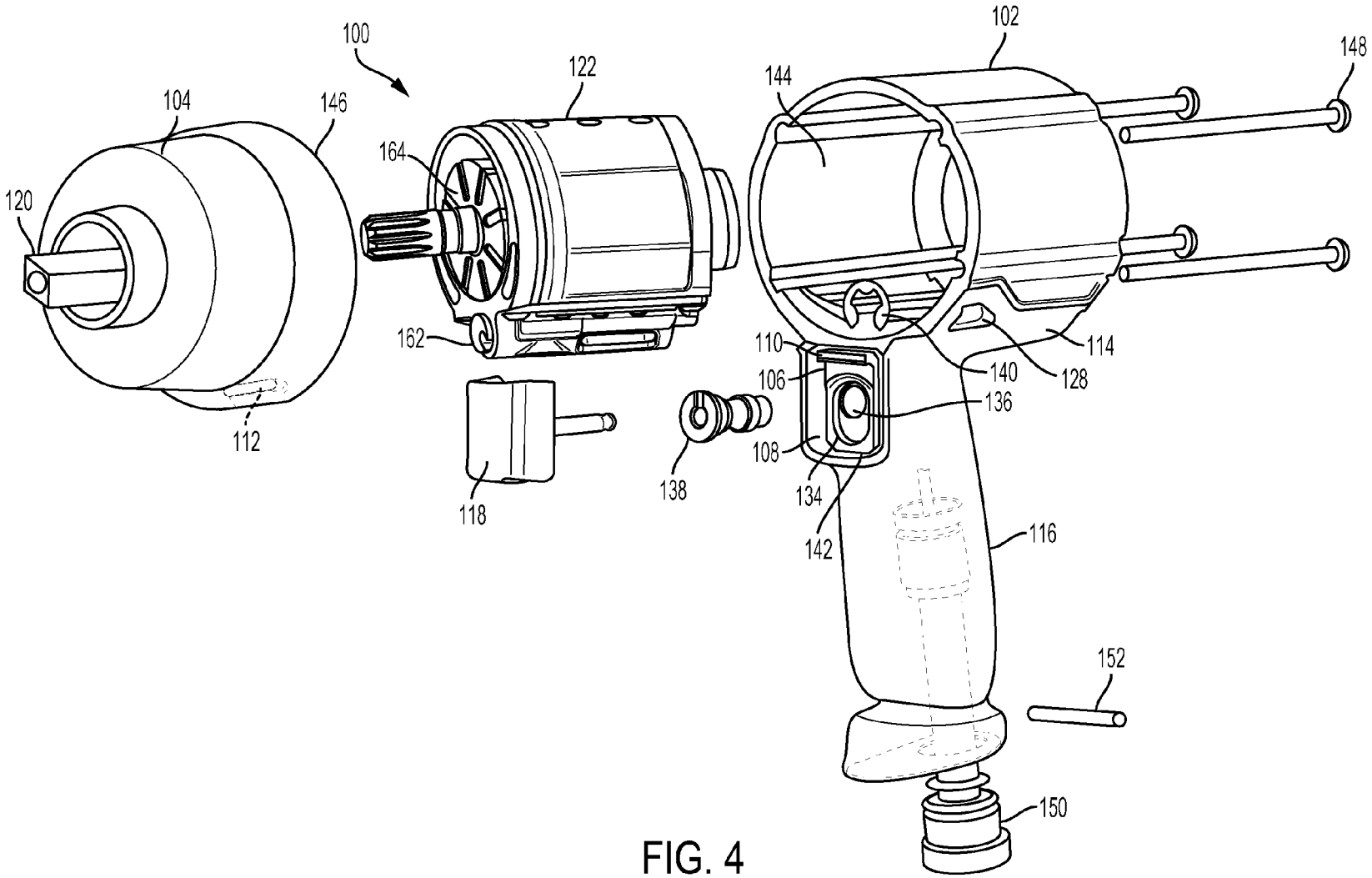
FIG. 4 is an exploded perspective view of a tool according to an embodiment of the present invention.
Figure 5:
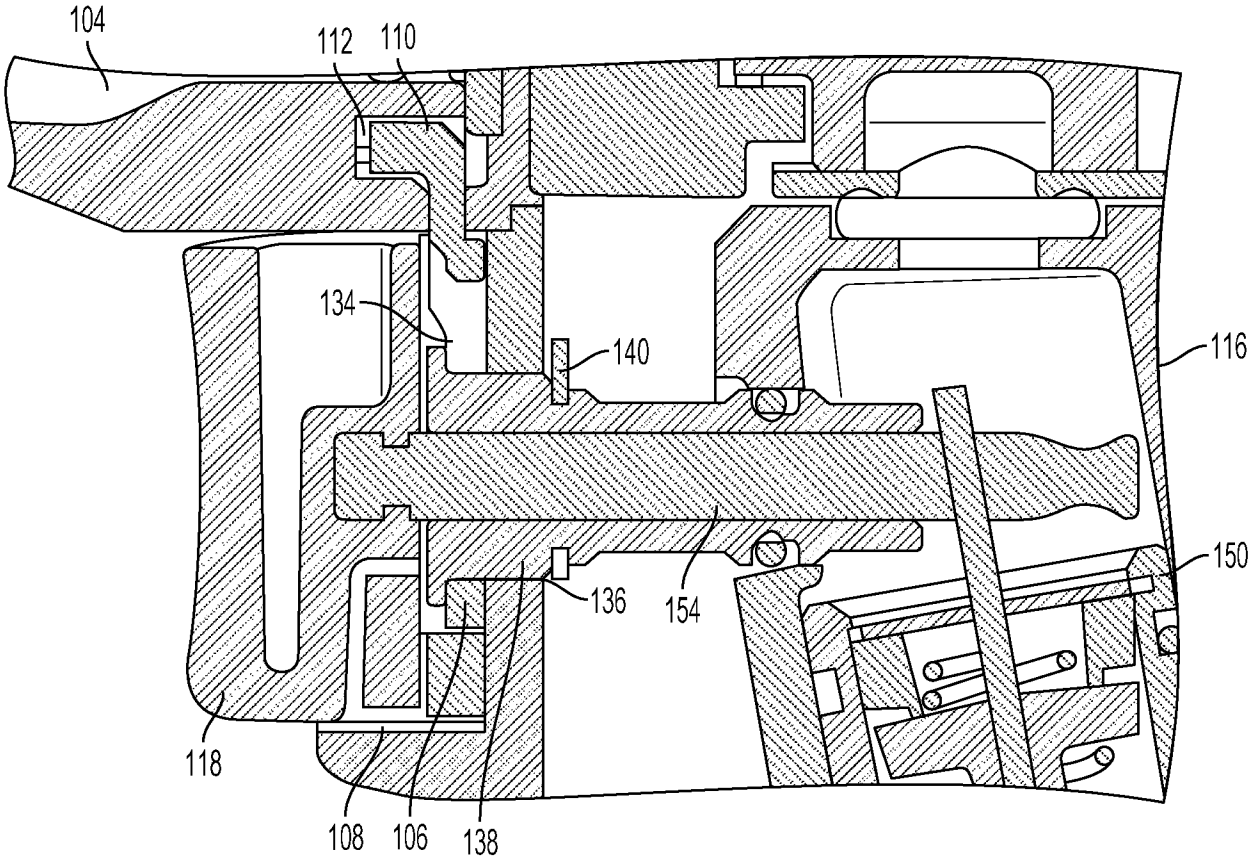
FIG. 5 is a cross-sectional view of a trigger area of a tool according to an embodiment of the present invention.

Referring to FIGS. 4 and 5, the reinforcement member 106 may be assembled onto the handle portion 116 of the first housing 102 by disposing the reinforcement member 106 in the recess 108 with the first side 130 and male protrusion 110 oriented in a direction of the second housing 104. The aperture 134 may also be aligned with a trigger receiving aperture 136 in the handle portion 116. A trigger bushing 138 may be disposed through the aperture 134 and into the aperture 136. A retaining ring 140 may then be disposed on the trigger bushing 138 in the first housing 102 to retain the trigger bushing 138 in the aperture 136. As illustrated, the retaining ring 140 is disposed within the housing 102 proximal to the second side 132 of the reinforcement member 106.

The reinforcement member 106 may initially be in a first position proximal to a bottom end 142 of the recess 108 (as illustrated in FIG. 4). This allows for the power and transmission components 122 to be disposed in a first cavity 144 of the first housing 102. Once the power and transmission components 122 are disposed in the first housing 102, the reinforcement member 106 may be moved upward to a second position away from the bottom end 142 of the recess 108 (as illustrated in FIG. 5). As illustrated, the aperture 134 is elliptical in shape, which allows for movement of the reinforcement member 106 from the first position to the second position.

The second housing 104 may then be assembled onto the first housing 102. As illustrated, the second housing 104 is disposed on the first housing 102, with a portion of the power and transmission components 122 being received in a second cavity 146 of the second housing 104. When the second housing 104 is assembled onto the first housing 102, the male protrusion 110 of the reinforcement member 106 is received in the female recess 112. The first and second housings 102, 104 respectively may then be coupled together, for example using fasteners 148.

The trigger 118 is inserted into the trigger bushing 138, and a valve subassembly 150 is inserted into the handle portion 116 and retained in the handle portion 116 by a retaining pin 152. As illustrated in FIG. 5, the trigger 118 may include a trigger shaft 154 that extends through the trigger bushing 138 and is coupled to the valve subassembly 150. When the trigger 118 is biased inwardly, relative to the tool 100, the valve subassembly 150 is opened, thereby causing the tool 100 to operate by pneumatic or fluid power. For example, an air or fluid supply may be coupled to the valve subassembly 150 to provide pneumatic or fluid power to the tool 100. When the trigger is released, and biased outwardly, relative to the tool 100, by the valve subassembly 150, the valve subassembly 150 closes, thereby causing the tool 100 to ceases operation.

Figure 6:
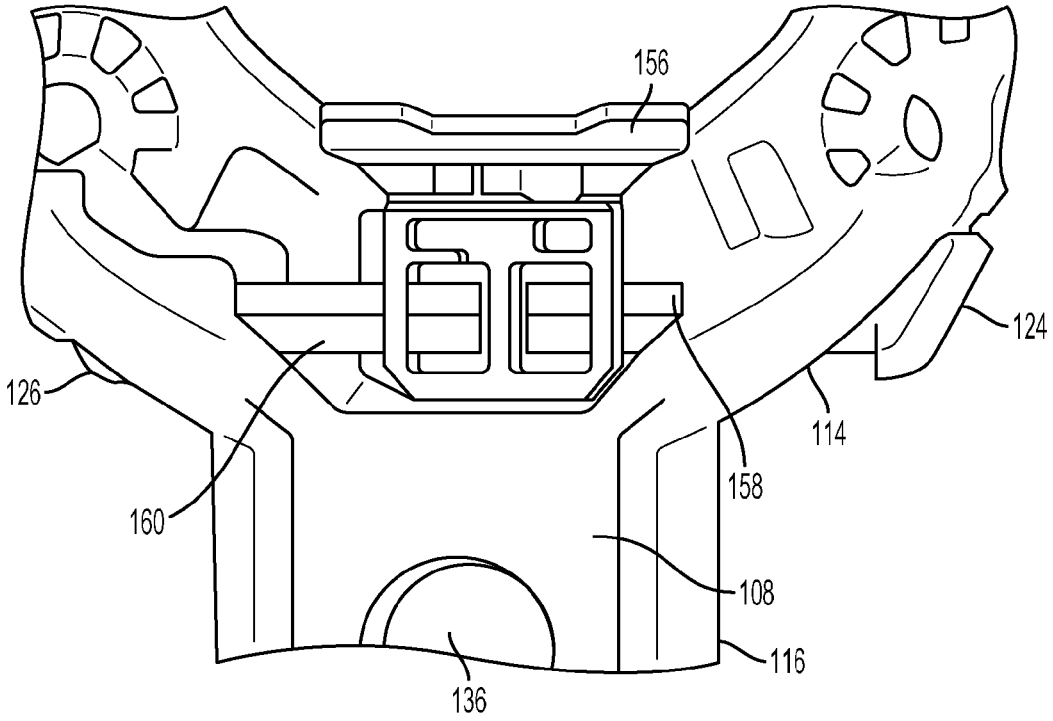
FIG. 6 is an enlarged sectional view of a reversing mechanism of a tool according to an embodiment of the present invention.

Referring to FIG. 6, the tool 100 may also include a reversing mechanism having the first and second buttons 124, 126 respectively corresponding to first and second directions of rotation. In an embodiment, the first and second buttons 124, 126 are operatively coupled together so that only one of the first and second buttons 124, 126 can be depressed at a time. In this embodiment, depressing the first button 124 inwardly relative to the tool 100 causes the second button 126 to move outwardly relative to the tool 100. Likewise, depressing the second button 126 inwardly relative to the tool 100 causes the first button 124 to move outwardly relative to the tool 100.

The first and second buttons 124, 126 respectively may be coupled to a switching base 156. For example, the first and second buttons 124, 126 respectively include first and second button arms 158, 160 extending into and coupling to the switching base 156. The switching base 156 may be coupled to a valve 162 (illustrated in FIG. 4), which may be part of the transmission and power components 122. In general, the valve 162 extends from the switching base 156 toward a rear of the tool 100, and is rotatably coupled to the switching base 156. In this respect, translational movement of the switching base 156 causes the valve 162 to rotate about an axis of the valve 162 and selectively distribute air or fluid to cause a clockwise or counterclockwise direction of a rotor 164 (illustrated in FIG. 4), which may be part of the transmission and power components 122, disposed within the tool 100, as known in the art.

Depressing either of the first and second buttons 124, 126 causes the switching base 156 to move linearly along a direction perpendicular to an axis of the valve 162, thereby causing the valve 162 to rotate. Rotation of the valve 162 causes selection of the rotational direction of the tool. For example, by directing air or fluid flow from an air or fluid source tangentially towards a left side of the rotor 164, causing the tool 100 to rotate in a clockwise direction, or directing air tangentially towards a right side of the rotor 164 to cause the air or fluid flow in a counterclockwise direction.

As discussed herein, the tool 100 can be a pneumatic tool such as an impact wrench. However, the tool 100 can be any pneumatically or hydraulically powered or hand-held tool, such as a screw driver, impact wrench, drill, saw, hammer, or any other tool. The tool 100 may also be any other type of electrically powered or manually powered tool or hand-held tool in which a structural reinforcement is desired to reduce potential failures caused by normal wear and tear, abuse, or dropping of the tool.

Further, as described herein, the reinforcement member 106 connects to the first housing 102 through the trigger bushing 138, and the second housing 104 via the recess 112. However, the shape and size of the reinforcement member 106 maybe adapted for other tools. For example, instead of connecting the reinforcement member through a trigger bushing, the reinforcement member may be connected through a switch housing of the tool. The reinforcement member may alternatively be connected to the first housing 102 by incorporating a recess or protrusion into the recess 108 that mates with a corresponding recess or protrusion of the reinforcement member. In this embodiment, the shape of the recess would prevent movement of the reinforcement member relative to the first housing 102, and the profile would spread the load over a large area to prevent deformation.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and/or described, it will be apparent to those skilled in the art that changes and modifications may be made without departing from the broader aspects of the invention. The actual scope of the protection sought is intended to be defined in the following claims when viewed in their proper perspective.

What is claimed is:

1. A tool, comprising:

a first housing portion including:

an upper portion adapted to receive power and transmission components; and a handle portion including a recess adapted to receive a trigger assembly;

a second housing portion coupled to the first housing portion; and a reinforcement member disposed in the recess and having:

a first side disposed in a first direction away from the recess and towards the second housing portion; and a protrusion extending from the first side in the first direction, the protrusion engaging the second housing portion and strengthening the handle portion to allow the handle portion to withstand forces resulting from the tool being dropped on a hard surface.

2. The tool of claim 1, wherein the recess includes a first aperture and the reinforcement member includes a second aperture, wherein the first and second apertures are aligned.

3. The tool of claim 2, wherein the second aperture is elliptical in shape.

4. The tool of claim 3, further comprising a trigger having a trigger shaft, the trigger shaft disposed in the trigger bushing.

5. The tool of claim 2, further comprising a trigger bushing extending through the second aperture and into the first aperture.

6. The tool of claim 1, wherein the second housing includes a second recess adapted to receive the protrusion.

7. A method of installing a reinforcement member of a tool, comprising:

disposing a reinforcement member in a recess in a handle portion of a first housing portion of the tool, wherein the reinforcement member includes a first side disposed in a first direction away from the recess and a protrusion extending from the first side in the first direction; and disposing a second housing portion of the tool on the first housing portion and in engagement with the protrusion.

8. The method of claim 7, further comprising aligning an aperture of the reinforcement member with a trigger receiving aperture in the handle portion.

9. The method of claim 8, further comprising disposing a trigger bushing through the aperture and into the trigger receiving aperture.

10. The method of claim 9, wherein aligning the aperture of the reinforcement member with the trigger receiving aperture includes disposing the reinforcement member in a first position proximal to a bottom end of the recess.

11. The method of claim 10, further comprising disposing power and transmission components in a first cavity of the first housing.

12. The method of claim 11, further comprising shifting the reinforcement member upward to a second position away from the bottom end of the recess.

13. The method of claim 12, wherein disposing the second housing portion on the first housing portion includes coupling the first and second housing portions together with one or more fasteners.

14. The method of claim 12, further comprising disposing a trigger in the trigger bushing.

15. The method of claim 9, further comprising disposing a retaining ring on the trigger bushing to retain the trigger bushing in the aperture.

16. The method of claim 7, further comprising disposing a valve subassembly into the handle portion.

17. A reinforcement member for a tool, comprising:

a first side and a second opposing side, the first side adapted to be disposed in a first direction away from a recess in a handle portion of the tool, wherein the handle portion is adapted to receive a trigger assembly;

a protrusion extending from the first side in the first direction, the protrusion adapted to engage a housing portion of the tool and strengthen the handle portion; and an aperture extending from the first side to the second side and adapted to align with a trigger receiving aperture in the recess of the handle portion.

18. The reinforcement member of claim 17, wherein the second side is adapted to disposed in a second direction facing the recess.

19. The reinforcement member of claim 17, wherein the aperture is elliptical in shape.

20. The reinforcement member of claim 17, wherein the reinforcement member is sized and shaped to fit into the recess.

* * * * *